US009251949B2

(12) United States Patent
Wu

(10) Patent No.: US 9,251,949 B2
(45) Date of Patent: Feb. 2, 2016

(54) MAGNETIC ELEMENT

(71) Applicant: Delta Electronics, Inc., Taoyuan Hsien (TW)

(72) Inventor: Tsung-Hsiao Wu, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 55 days.

(21) Appl. No.: 14/067,297

(22) Filed: Oct. 30, 2013

(65) Prior Publication Data

US 2014/0191836 A1 Jul. 10, 2014

(30) Foreign Application Priority Data

Jan. 8, 2013 (TW) ..... 102100521 A

(51) Int. Cl.
*H01F 27/29* (2006.01)

(52) U.S. Cl.
CPC ..... *H01F 27/29* (2013.01); *H01F 27/292* (2013.01); *H01F 2027/297* (2013.01)

(58) Field of Classification Search
CPC ..... H01R 27/00–27/30
USPC ..... 336/65, 83, 192, 196, 220–223
See application file for complete search history.

(56) References Cited

U.S. PATENT DOCUMENTS

| | | | | |
|---|---|---|---|---|
| 4,352,080 | A * | 9/1982 | Mitsui et al. | 336/83 |
| 6,734,777 | B2 * | 5/2004 | Yeh et al. | 336/208 |
| 2012/0182111 | A1 | 7/2012 | Gilmartin et al. | |

FOREIGN PATENT DOCUMENTS

| | | | |
|---|---|---|---|
| CN | 2864946 | Y | 1/2007 |
| CN | 101286409 | A | 10/2008 |
| CN | 201562574 | U | 8/2010 |
| JP | 6-112070 | A | 4/1994 |
| JP | 9-17664 | A | 1/1997 |
| TW | 200820277 | A | 5/2008 |

OTHER PUBLICATIONS

Office Action issued on Jul. 25, 2014 in corresponding TW patent application No. 102100521.
CN Office Action dated Sep. 30, 2015 from corresponding CN Appl No. 201310006101.5, 5 pp.

* cited by examiner

*Primary Examiner* — Tuyen Nguyen
(74) *Attorney, Agent, or Firm* — Muncy, Giessler, Olds & Lowe, P.C.

(57) ABSTRACT

A magnetic element is provided, including a magnetic core set, a bobbin, at least a wire, and an insulating base. The bobbin has a channel and a plurality of conductive pins, wherein the channel penetrates through the bobbin, and the magnetic core set is coupled with the channel. The wire is wound around the bobbin and connected to the conductive pins. The insulating base is connected to a bottom surface of the magnetic core set after the wire is wound around the bobbin and connected to the conductive pins, wherein the insulating base includes a plurality of protrusions adjacent to the conductive pins, respectively.

12 Claims, 4 Drawing Sheets

MAGNETIC ELEMENT

CROSS REFERENCE TO RELATED APPLICATIONS

The present application claims priority of Taiwan Patent Application No. 102100521, filed on Jan. 8, 2013, the entirety of which is incorporated by reference herein.

BACKGROUND

1. Technical Field

The present application relates to a magnetic element, and in particular, relates to a magnetic element having an insulating base.

2. Description of the Related Art

Conventional electronic devices usually include many magnetic elements, such as transformers. A transformer is a magnetic element capable of Electro-Magnetic Energy Conversion (EMEC) for adjusting voltage signal into a suitable range. Conventional transformers usually comprise at least a coil wound on a bobbin and a magnetic body.

With the increase in labor costs, assembly of the transformers may now be performed by automated machines. However, due to limited assembly precision of the automated machines, the distance between the pins of the bobbin usually has to be increased, thus the dimensions of the magnetic element are inevitably enlarged.

BRIEF SUMMARY

In view of the aforesaid problems, an embodiment of the disclosure provides a magnetic element, comprising a magnetic core set including a first magnetic core and a second magnetic core, wherein the first magnetic core and the second magnetic core respectively include a first magnetic block and a second magnetic block. A bobbin includes a channel and a plurality of conductive pins, wherein the channel penetrates through the bobbin for receiving the first magnetic blocks of the first magnetic core and the second magnetic core. At least a wire is wound around the bobbin and connected to the conductive pins, wherein the bobbin forms two side-walls with a groove formed therebetween for receiving the wire, and two ends of each of the side walls respectively have a guiding wall with the conductive pins disposed thereon. The magnetic core set is retained by the guiding walls. An insulating base contacts a bottom surface of the magnetic core set after the wire is wound around the bobbin and connected to the conductive pins. The second magnetic blocks of the first magnetic core and the second magnetic core are disposed between the insulating base and the bobbin. The insulating base includes a plurality of protrusions adjacent to the conductive pins, respectively.

BRIEF DESCRIPTION OF THE DRAWINGS

The present disclosure can be more fully understood by reading the subsequent detailed description and examples with references made to the accompanying drawings, wherein.

DETAILED DESCRIPTION

Figure 1A:
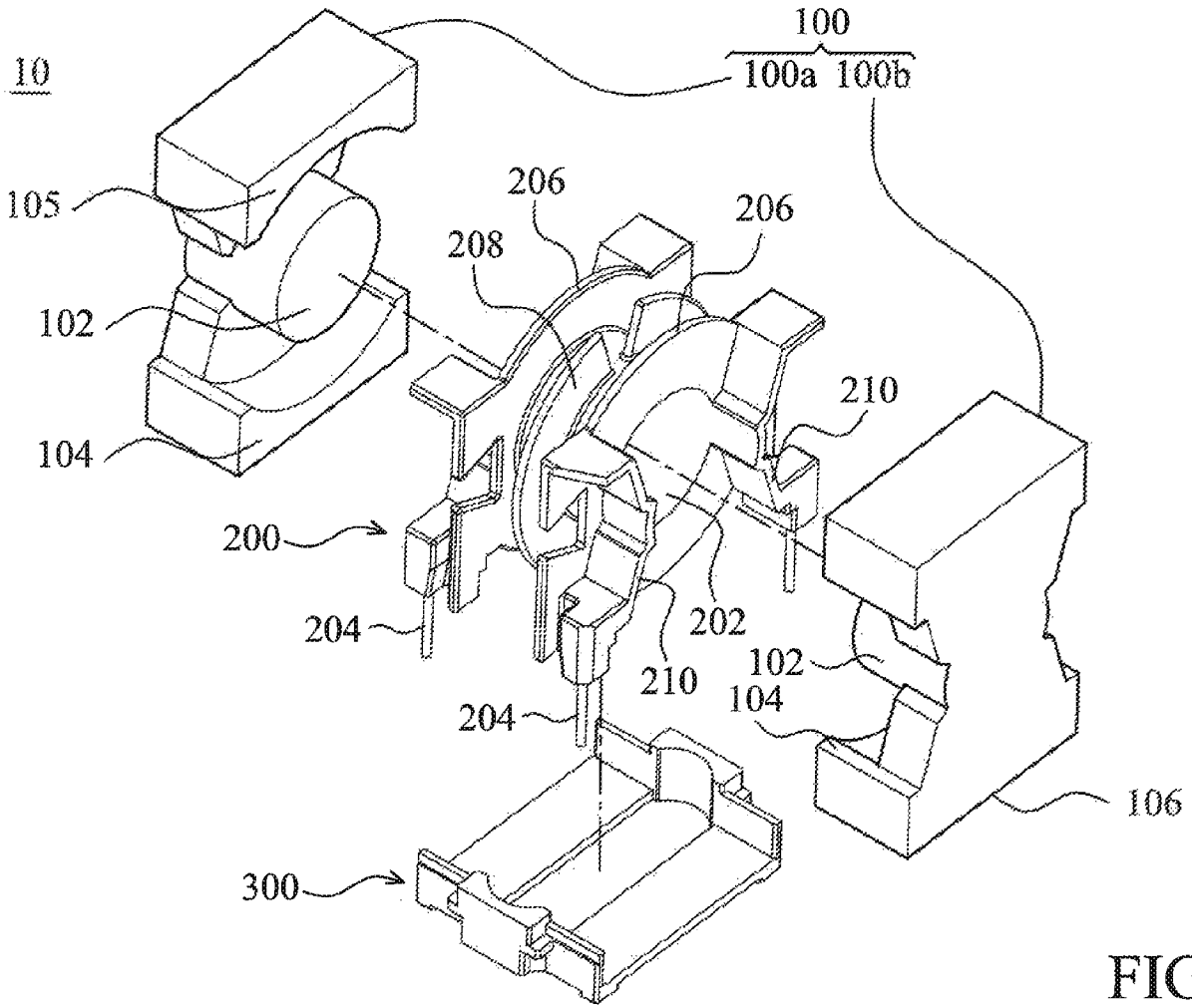
FIG. 1A is an exploded diagram of a magnetic element according to an embodiment of the present disclosure.
Figure 1B:
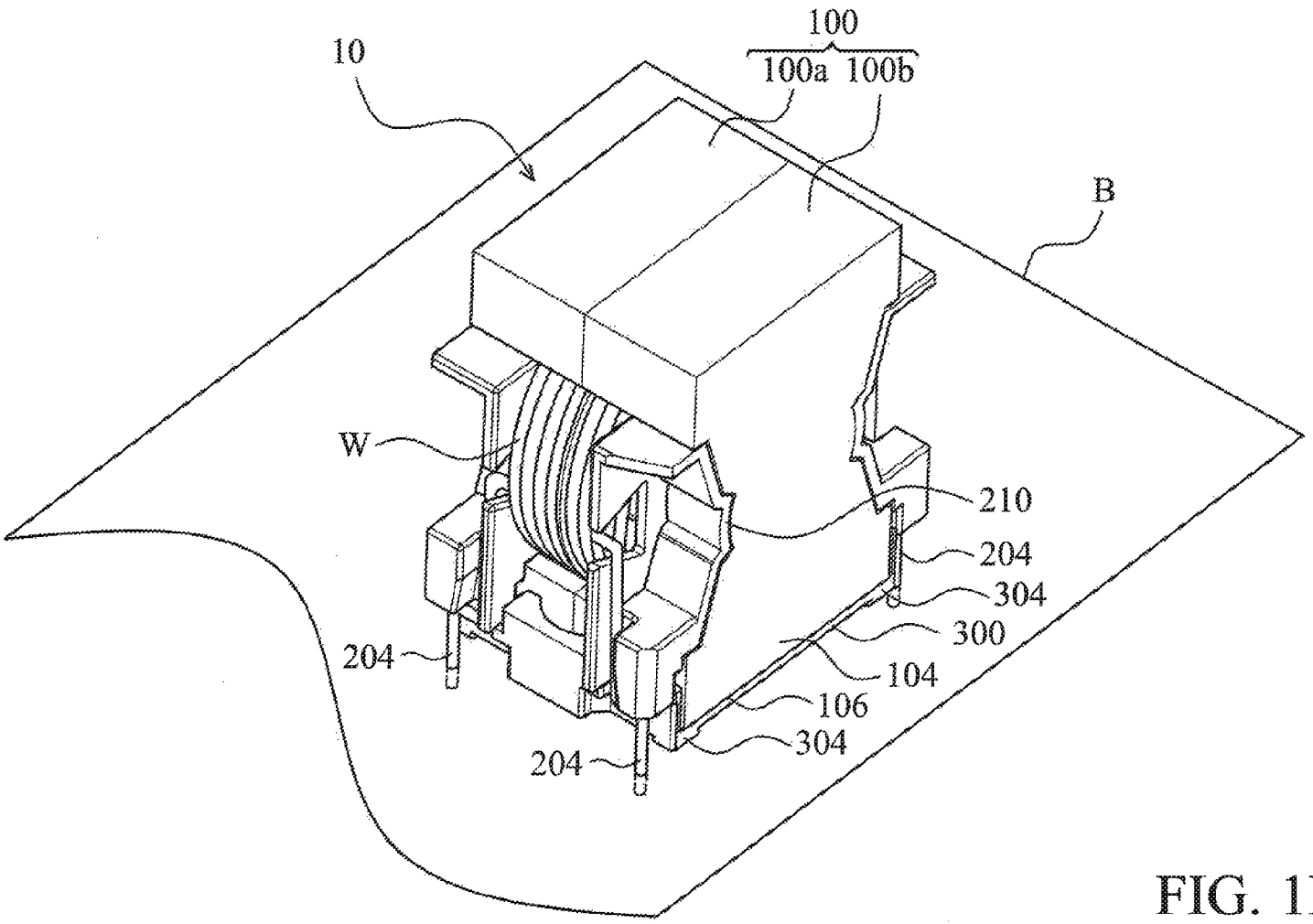
FIG. 1B a perspective diagram of the magnetic element of FIG. 1A, wherein the magnetic element is disposed on a circuit board.

Referring to FIG. 1A and FIG. 1B, the magnetic element 10 primarily comprises a magnetic core set 100 including a first magnetic core 100*a* and a second magnetic core 100*b*, at least a wire W, and a bobbin 200. The first magnetic core 100*a* and the second magnetic core 100*b* respectively include a cylindrical first magnetic block 102, a second magnetic block 104, and a third magnetic block 105. In this embodiment, the first magnetic core 100*a* and the second magnetic core 100*b* respectively form an E-shaped structure. In some embodiments, the first magnetic core 100*a* and the second magnetic core 100*b* may respectively form a U-shaped structure having only two magnetic blocks 102 and 104 without the third magnetic block 105. The bobbin 200 includes a channel 202 and four conductive pins 204, wherein the channel 202 penetrates through the bobbin 200, and the first magnetic blocks 102 of the first magnetic core 100*a* and the second magnetic core 100*b* are extended through the channel 202 from both ends thereof.

To clearly show the bobbin 200, the wire W wound around the bobbin 200 is omitted in FIG. 1A. Referring to FIG. 1A, both sides of the bobbin 200 respectively form a side-wall 206 with a groove 208 formed therebetween. As shown in FIG. 1B, the wire W is received in the groove 208, and two ends of the wire W are respectively connected to the conductive pins 204. One or more wires W can be provided, depending on the type of the magnetic element 10 (e.g. a transformer, filter, or inductance element).

Referring to FIG. 1A and FIG. 1B, the side-walls 206 respectively form two symmetrical guiding walls 210. The shape of guiding walls 210 matches that of the magnetic core set 100, so that the magnetic core set 100 can be retained by the guiding walls 210 (FIG. 1B). The conductive pins 204 are respectively extended from the guiding walls 210. In this embodiment, the bobbin 200, the side-walls 206, and the guiding walls 210 are integrally formed in one piece.

Specifically, the magnetic element 10 further includes an insulating base 300 disposed between a circuit board B and the magnetic core set 100 (FIG. 1B). After the wire W is wound around the bobbin 200 and connected to the conductive pins 204, then the first magnetic blocks 102 of the first magnetic core 100*a* and the second magnetic core 100*b* are disposed in the channel 202, and the insulating base 300 is connected to a bottom surface 106 of the magnetic core set 100. In this state, the second magnetic blocks 104 of the first magnetic core 100*a* and the second magnetic core 100*b* are situated between the insulating base 300 and the bobbin 200.

Figure 2:
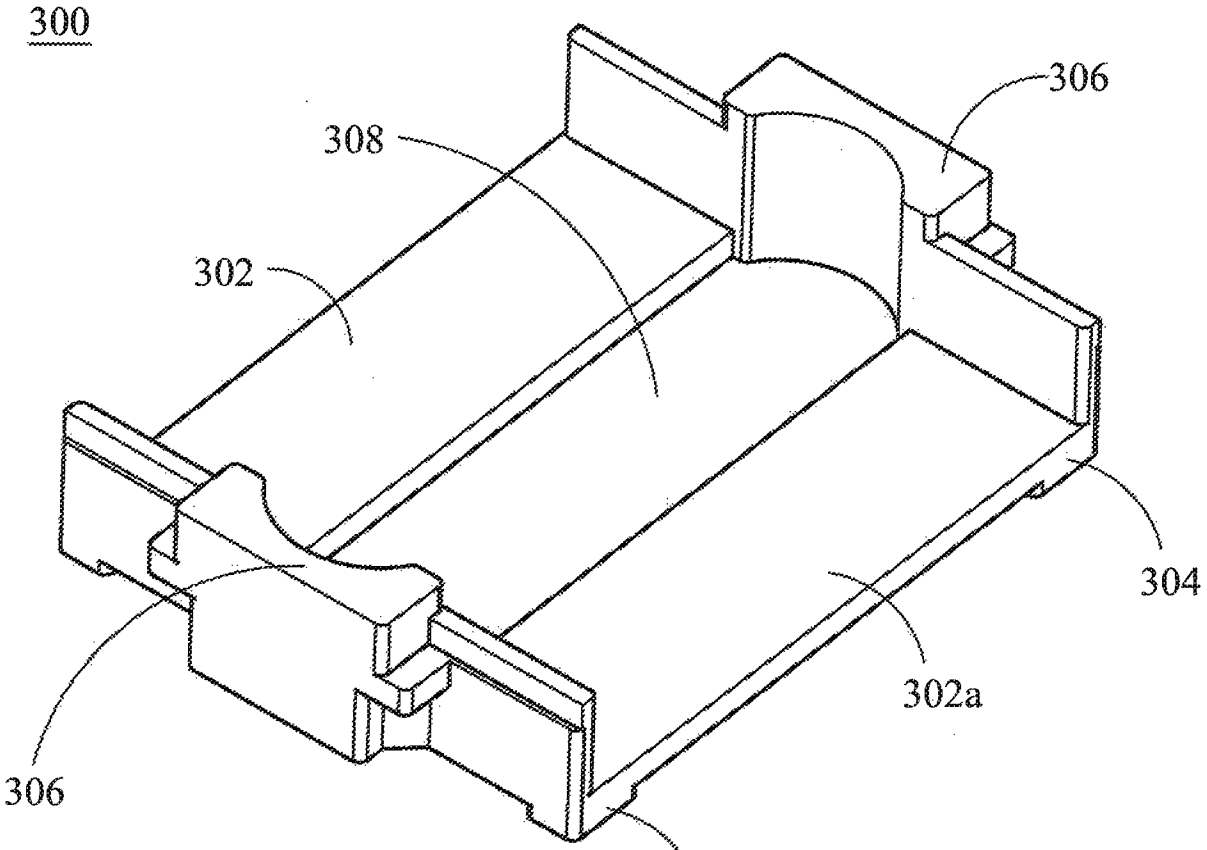
FIG. 2 is a schematic view of an insulating base according to an embodiment of the present disclosure.

Referring to FIG. 1B and FIG. 2, the insulating base 300 primarily includes a main body 302, a plurality of protrusions 304, and two restricting structures 306. In this embodiment, the insulating base 300 has four protrusions 304 formed at four corners of a bottom surface of the main body 302 and adjacent to four conductive pins 204 of the bobbin 200, respectively (i.e. the quantities of the protrusions 304 and the conductive pins 204 are the same). The restricting structures 306 protrude from opposite ends of a top surface of the main body 302, respectively, so that a receiving space 302*a* is formed between the main body 302 and the restricting structures 306. According to the aforesaid structural features, when the magnetic element 10 is mounted on the circuit board B, the protrusions 304 of the insulating base 300 can contact the circuit board B. Thus, the magnetic element 10 can be stably disposed on the circuit board B, and because the insulating base 300 is disposed between the circuit board B and the magnetic core set 100, direct contact between the magnetic core set 100 and the circuit of the circuit board B can be prevented.

Figure 3:
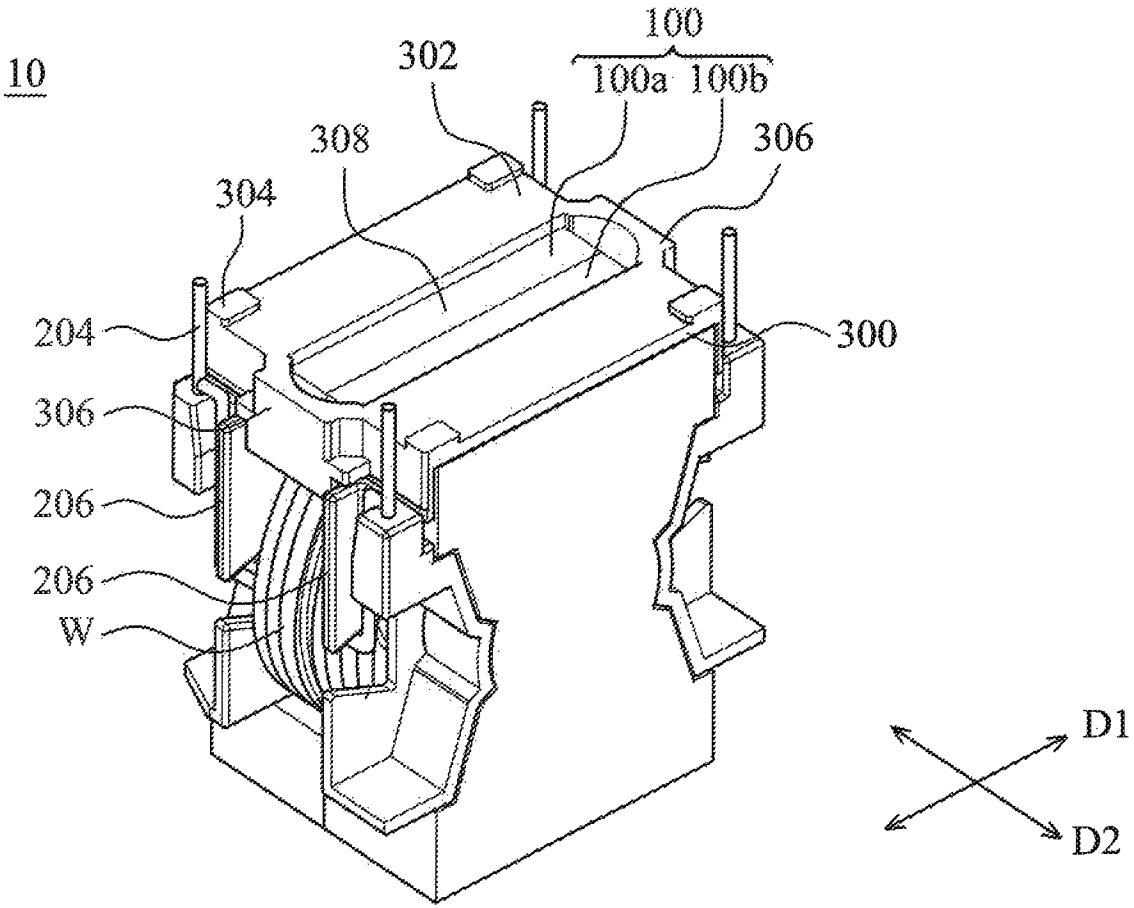
FIG. 3 schematically shows an insulating base according to an embodiment of the present disclosure, combined with a magnetic core and a bobbin.

During assembly of the insulating base 300, the magnetic core set 100, and the bobbin 200 (FIG. 2 and FIG. 3), the magnetic core set 100 is disposed in the receiving space 302*a* and against the two restricting structures 306 of the insulating base 300, thus preventing the insulating base 300 from moving in a first direction D1 relative to the magnetic core set 100. The restricting structures 306 are respectively disposed between and against the two side-walls 206 of the bobbin 200, thus also preventing the insulating base 300 from moving in a second direction D2 (perpendicular to the first direction D1) relative to the bobbin 200 and improving the structural stability of the magnetic element 10. In addition, the main body 302 of the insulating base 300 may further include a hollow 308 (FIG. 2 and FIG. 3) corresponding to an adjoining surface of the second magnetic blocks 104 of the first magnetic core 100*a* and the second magnetic core 100*b* (FIG. 1A). Thus, the connection of the insulating base 300 and the magnetic core set 100 may not be influenced by the glue overflowing between the second magnetic blocks 104 of the first magnetic core 100*a* and the second magnetic core 100*b*, and better heat dissipation of the magnetic element 10 can be achieved.

As mentioned above, the present disclosure provides a magnetic element having an insulating base with protrusions, wherein the assembly of the insulating base is executed after the wire is wound around the bobbin and connected to the conductive pins. Accordingly, the protrusions of the insulating base may not affect the winding process of the automated machine. Thus, the magnetic element of the present disclosure can be produced by automated machines without enlarging the dimensions thereof, so as to improve the yield of the production.

While the present disclosure has been described by way of example and in terms of the preferred embodiments, it is to be understood that the present disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A magnetic element, comprising:

a magnetic core set, including a first magnetic core and a second magnetic core, wherein the first magnetic core and the second magnetic core respectively include a first magnetic block and a second magnetic block;

a bobbin, including a channel and a plurality of conductive pins, wherein the channel penetrates through the bobbin for receiving the first magnetic blocks of the first magnetic core and the second magnetic core;

at least a wire, wound around the bobbin and connected to the conductive pins, wherein the bobbin forms two side-walls with a groove formed therebetween for receiving the wire, and two ends of each of the side-walls respectively have a guiding wall with the conductive pins disposed thereon, wherein the magnetic core set is retained by the guiding walls; and an insulating base, contacting to a bottom surface of the magnetic core set after the wire is wound around the bobbin and connected to the conductive pins, wherein the second blocks of the first magnetic core and the second magnetic core are disposed between the insulating base and the bobbin, and the insulating base includes a plurality of protrusions adjacent to the conductive pins, respectively.

2. The magnetic element as claimed in claim 1, wherein the insulating base further includes a main body and two restricting structures protruding from two ends of the main body, respectively, wherein the main body and the restricting structures form a receiving space with the magnetic core set disposed therein.

3. The magnetic element as claimed in claim 2, wherein the magnetic core set is against the restricting structures.

4. The magnetic element as claimed in claim 2, wherein the restricting structures are against the side-walls of the bobbin respectively.

5. The magnetic element as claimed in claim 2, wherein the magnetic core set is against the restricting structures, and the restricting structures are against the side-walls of the bobbin respectively.

6. The magnetic element as claimed in claim 2, wherein the main body has a hollow corresponding to an adjoining surface between the second blocks of the first magnetic core and the second magnetic core.

7. The magnetic element as claimed in claim 6, wherein the magnetic core set is against the restricting structures.

8. The magnetic element as claimed in claim 6, wherein the restricting structures are against the side-walls of the bobbin respectively.

9. The magnetic element as claimed in claim 6, wherein the magnetic core set is against the restricting structures, and the restricting structures are against the side-walls of the bobbin respectively.

10. The magnetic element as claimed in claim 1, wherein the insulating base further includes a main body having a hollow corresponding to an adjoining surface between the second blocks of the first magnetic core and the second magnetic core.

11. The magnetic element as claimed in claim 1, wherein the magnetic element is disposed on a circuit board, and the insulating base is disposed between the circuit board and the magnetic core set, wherein the conductive pins electrically connect to the circuit board, and the protrusions contact the circuit board to stand the magnetic element on the circuit board stably.

12. The magnetic element as claimed in claim 1, the insulating base further includes a main body and the protrusions are formed at corners of a bottom surface of the main body.

* * * * *